United States Patent [19]

Lennis et al.

[11] 4,338,895

[45] Jul. 13, 1982

[54] INSERTLESS DISTRIBUTOR CAP

[75] Inventors: Ralph J. Lennis, Farmington Hills; Ralph L. Handy, Troy, both of Mich.

[73] Assignee: Chrysler Corporation, Highland Park, Mich.

[21] Appl. No.: 182,179

[22] Filed: Aug. 28, 1980

[51] Int. Cl.[3] ..... F02P 7/00

[52] U.S. Cl. ..... 123/146.5 A; 200/19 DC; 339/217 S

[58] Field of Search ..... 123/146.5 A; 339/217 S; 200/19 DC

[56] References Cited

U.S. PATENT DOCUMENTS

| | | | |
|---|---|---|---|
| 3,525,975 | 8/1970 | Krantwald et al. | 339/217 S |
| 3,748,633 | 7/1973 | Lundergan | 339/217 S |
| 3,789,349 | 1/1974 | Scott | 339/256 SP X |
| 3,951,508 | 4/1976 | Farrer et al. | 200/19 DC X |

*Primary Examiner*—Tony M. Argenbright

*Attorney, Agent, or Firm*—Newtson & Dundas

[57] ABSTRACT

An insertless distributor cap for use with an ignition distributor of an internal combustion engine. The cap comprises novel structure internally of the cap towers which facilitates assembly of terminal electrodes directly to the cap and improved retention when assembled.

14 Claims, 11 Drawing Figures

INSERTLESS DISTRIBUTOR CAP

FIELD AND BACKGROUND

This invention relates to an improved "insertless" form of automotive cap characterized by removable output distribution electrodes.

Conventional distributor caps have high tension distribution electrodes which are permanently affixed in the cap. The electrodes are metallic circular inserts which are loaded and must be accurately positioned on locator or mold pins in the mold and are subsequently machined to specific dimensions after molding to prevent a flat surface to the distributor rotor electrode.

U.S. Pat. No. 3,789,349 depicts a prior form of "insertless" distributor cap in which the outer electrodes are not molded in and are not permanently affixed in the cap. Each of the outer towers projecting from the domed end of the cap receives a readily removable distributor electrode, one end of which extends into the interior of the cap through slotted opening in the dome thereof in which it is frictionally retained in the cap. The other end of the electrode has a conductive ferrule thereon by which it is attached to one end of a high tension ignition cable, which carries a conventional insulating rubber boot or nipple coaxially surrounding the combined distributor terminal electrode and ignition cable termination.

In addition to simplification of construction and reduction of manufacturing cost afforded by the elimination of locator or positioning pins and the elimination of the necessity to machine the inserts after the molding process, the described form of insertless distributor cap reduces problems of terminal corrosion and loose plug wire connections commonly encountered with conventional distributor caps. However, in closely confined quarters of a crowded engine compartment, insertion of cable attached distributor electrodes into the tower of the distributor cap may be difficult and the electrode may not be properly seated and inserted to a sufficient depth into the interior of the mounted cap for proper cooperation with the distributor input or rotor electrode. Moreover, the frictional retention of the output electrodes in the distributor cap renders the electrodes subject to accidental withdrawal and to displacement or movement by the shock and vibration environment in which the distributor is mounted, resulting in missing and misfiring of the engine.

Accordingly, the present invention has among its objects to provide an improved form of insertless distributor cap and removable output electrode therefor to facilitate blind insertion and alignment of the electrode as well as positive seating and locking thereof within the interior of the cap.

Other objects are to provide an insertless form of distributor cap in which none of the high tension distributor cap electrodes, including the central inner input terminal electrode as well as the outer or output terminal electrodes, is molded in the cap and in which the output terminal electrodes are positively guidingly received and aligned upon insertion of the cap.

Still other objects are to provide a completely insertless form of distributor cap with positive snap-in retention features for the central terminal input electrode and the outer output terminal electrodes.

The above and other objects and advantages of the invention will appear more fully from consideration of the following detailed description of the preferred embodiment of the invention made with reference to the accompanying drawings.

DESCRIPTION OF THE PREFERRED EMBODIMENT

Figure 1:
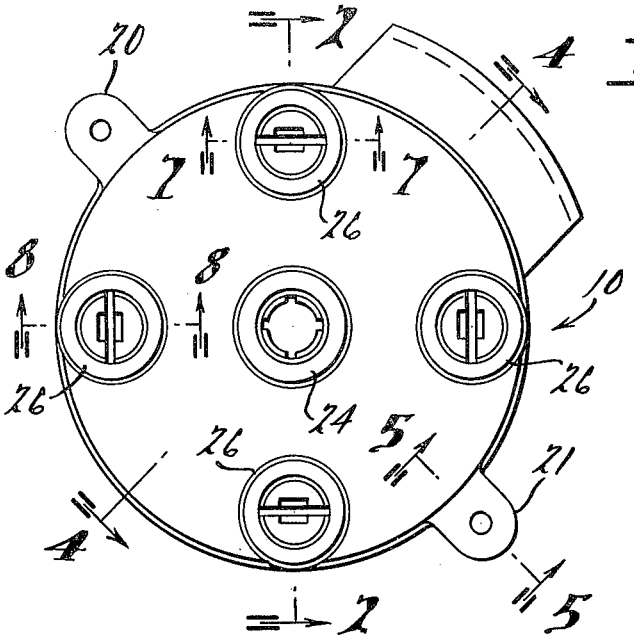
FIG. 1 is a top plan view of a distributor cap in accordance with the present invention.
Figure 5:
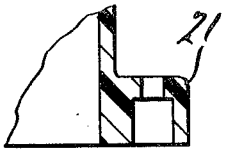
FIG. 5 is a fragmentary vertical elevation sectional view taken in the direction 5—5 of FIG. 1.
Figure 2:
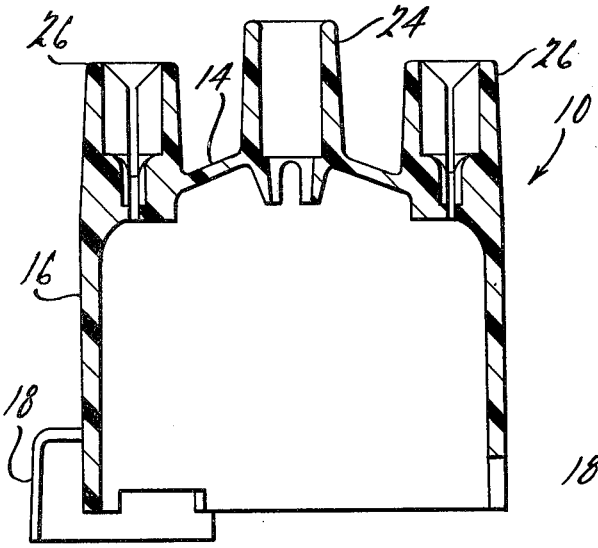
FIG. 2 is a vertical elevation sectional view taken in the direction 2—2 of FIG. 1.
Figure 4:
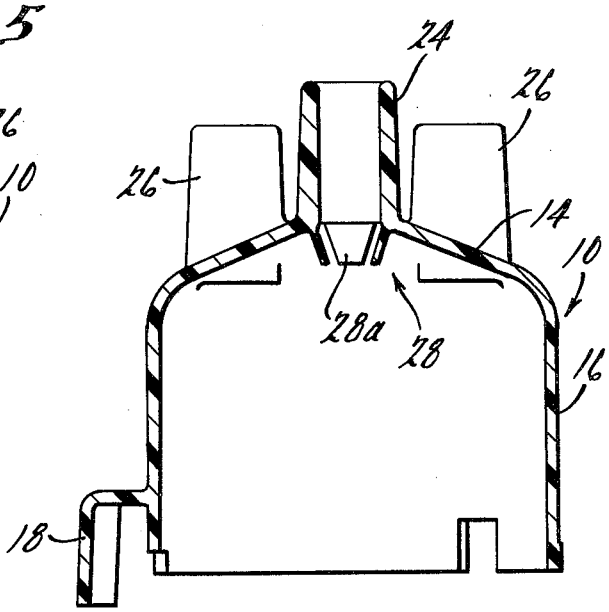
FIG. 4 is a vertical elevation sectional view taken in the direction 4—4 of FIG. 1.
Figure 3:
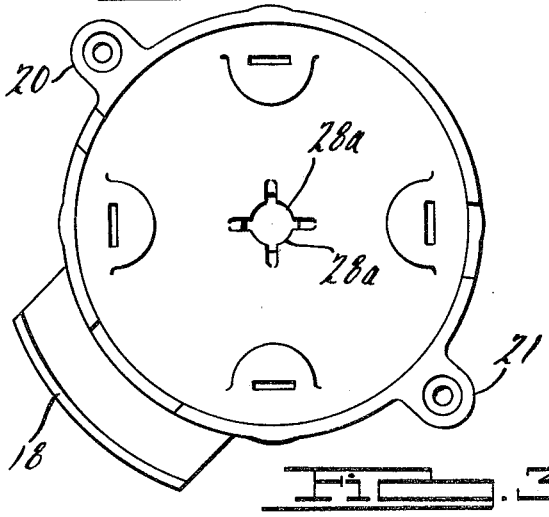
FIG. 3 is a bottom view of the distributor cap of FIG. 1.
Figure 6:
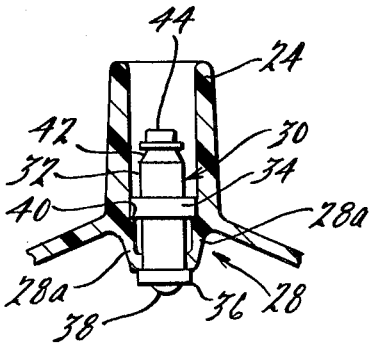
FIG. 6 is a vertical longitudinal view with parts broken away of the press-in central terminal electrode for the distributor cap.

With reference to the drawings, FIGS. 1 and 2 illustrate distributor cap 10 in accordance with the present invention for use with an automotive-type distributor of the type shown in U.S. Pat. No. 4,165,726 for example. While the illustrated cap is for a four cylinder internal combustion engine, the constructional features thereof may be applied to engines of a larger number of cylinders, as well.

Cap 10, which is molded of one piece dielectric insulating plastic material such as a polyester thermal-plastic, is an inverted cup-shaped member having a domed upper end portion 14 and an adjoining depending cylindrical side or skirt portion 16 having an outwardly and downwardly depending splash shield 18 formed on one side thereof. At the lower open end of the cap is an integrally formed pair of diametrically disposed, radially outwardly extending ears or lugs 20, 21 by which the cap may be detachably mounted a bowl-shaped distributor housing shown at 12 in the aforementioned patent.

Projecting from the domed or crowned end of the cap are a plurality of integrally formed tubular walled towers, including an inner tower 24 located inwardly centrally of a circular array of side or outer towers 26, which are equally angularly disposed about the outer periphery of the cap.

The towers are of a frusto-conical external and internal configuration, each of the towers being of lesser outer diametrical dimension at its outer end than at its lower end proximate the domed portion 14 of the cap and of slightly greater inner diametrical dimension at its outer end than at its lower end adjacent the domed end of the cap. In axial alignment with the inner tower 24, and extending inwardly into the cap is a thin walled, circular, frusto-conical tubular section 28 slotted in each of the quadrants thereof to provide a circular array of four relatively thin radially expandable or yieldable fingers 28*a* for reception and retention of a conductive metallic plug 30 therein. Plug 30 constitutes the distributor input electrode and is a premachined cylindrical member.

Plug 30 comprises a main cylindrical body 32, a shoulder 34 disposed centrally around the outside of main body 32 and a shoulder 36 in the lower end of body 32. a button 38 of a spherical shape is exposed at the inner or lower, as viewed in the drawing, end of plug 30. Plug 30 is assembled to the distributor cap by insertion through the open upper end of tower 24. During insertion, shoulder 36 abuts the fingers 28*a* with continued insertion displacing the plug more fully into the cap and flexing the fingers outwardly. Upon full insertion shoulder 36 clears the distal ends of the fingers 28*a* allowing the fingers to return toward their unflexed condition and currently shoulder 34 abuts a ledge 40 on the inner wall of the tower. In this way the foregoing described structure cooperates to retain the plug in the distributor cap. Also, the shoulder 36 is of a diameter which fits closely within the tower. The button 38 provides contact with the contact spring of distributor rotor (not shown) which rotates in synchronism with the engine to selectively connect the individual terminals in the outer towers with plug 30. The upper portion of plug 30 is provided with a groove 42 and head 44 which provides for connection of a cable from the ignition coil secondary to the distributor. The mechanical connection is effected in the same manner as the secondary ignition wires are connected to the spark plugs in the conventional current production ignition system.

Figure 7:
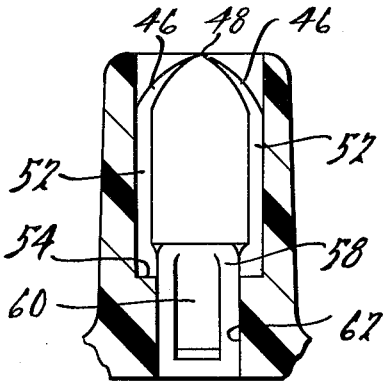
FIGS. 7 and 8 are enlarged vertical sectional elevation views of an outer tower portion of the distributor cap taken in the directions 7—7 and 8—8 of FIG. 1.
Figure 8:
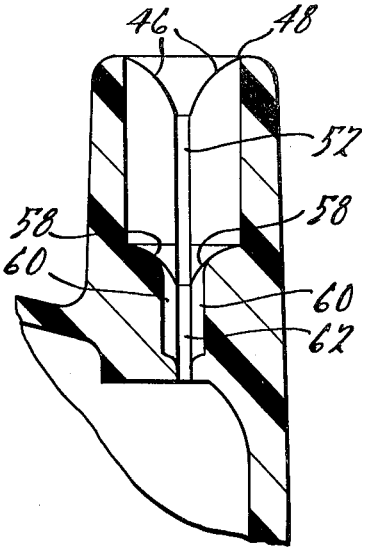

Turning now to FIGS. 7 and 8, one can see further details of the construction of the interior wall of the outer towers. Beginning at the upper end of the outer tower and continuing downwardly into the tower are a pair of diametrically opposed inverted V-shaped camming surfaces 46. FIG. 7 best shows one of the V-shaped surfaces 46 by itself. Looking to FIG. 7, apex of the inverted V is indicated at 48 and the camming surfaces 50 extend downwardly of the tower and they extend circumferentially of the tower as they proceed downwardly. The circumferential extent of each inverted V is slightly less than 180° as can been seen from consideration of FIGS. 1, 7 and 8. The camming surfaces 46 terminate at straight axially extending diametrically opposed grooves 52. The grooves 52 continue downwardly terminating at respective shoulders 54. As will be seen in the ensuing description later on the shoulders 54 provide stops which limit the insertion of the terminals. Additional internal structure in the form of a pair of inclined ledge surfaces 58 is also included. These ledge surfaces 58 as will also be seen later, are useful in connection with the assembly of the terminal. Rectangularly shaped notches 60 form indentations in the central portion of the surfaces 58 providing for clearance as will be explained later. A rectangular slot 62 forms the opening which passes through the cap of the distributor which allows the free end of the inserted terminal to pass through the top of the cap and into the cap interior.

Figure 9:
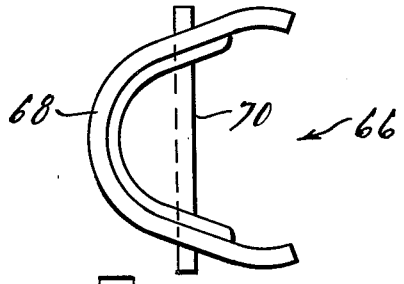
FIGS. 9, 10 and 11 are enlarged top, side and end views, respectively, of the terminal electrode for an outer tower of the distributor cap.
Figure 10:
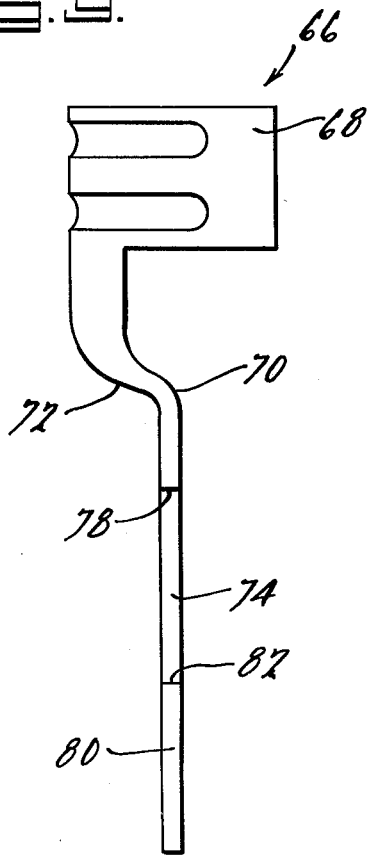
Figure 11:
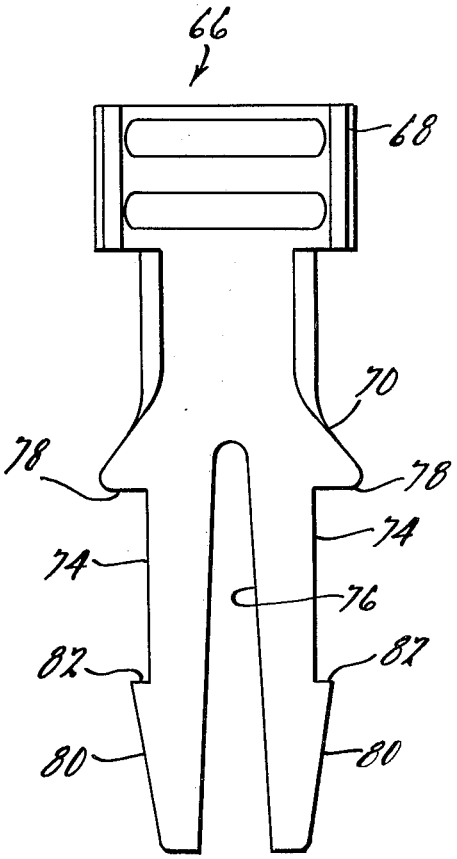

Turning now to FIGS. 9–11, details of the terminal electrodes are disclosed. The terminal electrode 66 is of one piece construction and has a clasp portion 68 which provides for attachment to an ignition cable and a blade portion 70 which both retains the terminal electrode on the distributor cap in conjunction with the cap structure described above, and which extends into the interior of the cap to confront the tip of the rotating rotor blade as the rotor rotates. The drawing illustrates the terminal electrode 66 prior to attachment to an ignition cable. The clasp portion 68 is open to receive the end segment of the ignition cable at the initial stage of attachment. Subsequently the clasp is wrapped around the ignition cable to establish the mechanical and electrical connection, the actual connection being performed by the conventional tuck and fold procedure wherein the outer insulation structure is stripped from the end segment of the cable and the exposed conductor is tucked around back of the remaining insulator and at this point the clasp 68 is attached.

The blade portion 70 includes a bend 72 which forms a transition between clasp 68 and the flat portion which comprises a pair of legs 74. A notch 76 separates the two legs and the legs includes tabs 78 and tangs 80 as shown.

The purpose of the tangs 80 is to lock, by means of the notches 82 the terminal in place once it is properly fully inserted. The tabs 78 provide a locating stop which limits the insertion into the cap. Additionally, the tabs 78 cooperate with the inverted V-shaped camming surfaces to bring the terminal into alignment with the grooves 52. In the assembled condition, the blade portion 70 aligns with the grooves 52 and passes through the rectangular slot 62 into the interior of the cap. If during insertion the blade is incorrectly circumferentially oriented the V-shaped camming surfaces interact with the tabs 78 to bring the terminal into the proper alignment as it is inserted more fully into the tower. The ledges 58 are spaced somewhat below the V-shaped surfaces and function as a centering device for the distal end of the blade, further facilitating the assembly. The notches 60 are in the nature of reliefs providing clearance facilitating the centering process.

Once alignment has been secured, the tabs 78 ride in the grooves 52 and the tangs 80 interact with the shorter side walls of the rectangular slot forming the opening into the interior of the cap. The legs 74 are thereby increasingly flexed toward each other as the terminal is more fully inserted. Upon full insertion the tabs 78 abut the shoulders 54 and the tangs 80 clear the top of the cap at the inner end of the rectangular slots allowing the legs to flex away from each other toward their relaxed condition thereby interlocking the terminals on the distributor cap by notches 82.

There has been provided a new and unique construction for a distributor cap with particular reference to the facilitation of assembly of terminals to the cap and secure retention to the cap. If it becomes necessary to remove the terminals from the cap, the cap may be removed to expose the interior and a suitable tool, such as a pair of pliers, may be used to grasp the free ends of the legs 74 and flex them toward each other to release the notches 82 from engagement with the cap thereby allowing the terminal to be removed via the top of the tower. In the assembled cap in a distributor, the exposed portions of legs 74 (i.e., 80) form the electrode structure which confronts the rotating distributor rotor tip.

What is claimed is:

1. A dome-shaped distributor cap having a plurality of axially extending tubular walled towers equally angularly spaced about the outer periphery and projecting from the domed end of the cap for reception of one end of a respective one of a like plurality of high tension ignition cables, said cap having a like plurality of equally angularly spaced openings located in and extending through the dome of the cap and into the interior of a respective one of the tubular tower projections for reception of one end of a readily insertable and removable elongated terminal electrode attached at its other end to a respective one of said ignition cables, each of said tubular walled tower projections characterized by camming guide means integrally formed on the inner wall thereof and cooperating with a cable terminal electrode for guiding insertion of said one end of a cable terminal electrode through an opening in the dome of the cap and into the interior of the cap during assembly of the electrode to the cap.

2. A cap as claimed in claim 1, said camming guide means formed as a narrow flat inclined ledged surface adjacent the inner wall of a tubular tower.

3. A cap as claimed in claim 2, said openings formed as narrow rectangular slits and said tubular towers having a pair of axially extending oppositely diametrically spaced narrow grooves formed on the inner wall thereof and aligned with a respective one of said slits.

4. A cap as claimed in claim 2, said camming guide means comprising a diametrically opposed pair of inverted V-shaped camming surfaces.

5. A cap as claimed in claim 4, wherein said inverted V-shaped camming surfaces terminate at axially extending grooves which continue inwardly of the corresponding tower.

6. A cap as claimed in claim 5 said grooves terminating at respective shoulders at the upper end of the corresponding opening.

7. A cap as claimed in claim 6, said opening being rectangular in cross section and in alignment with said grooves.

8. A cap as claimed in claim 5, including centering means facilitating insertion of a terminal, said centering means being inclined surfaces in the vicinity of the inner ends of the grooves.

9. A dome-shaped distributor cap having a plurality of axially extending tubular walled towers equally angularly spaced about the outer periphery and projecting from the domed end of the cap for reception of one end of a respective one of a like plurality of high tension ignition cables, said cap having a like plurality of equally angularly spaced openings located in and extending through the dome of the cap and into the interior of a respective one of the tubular tower projections for reception of one end of a readily insertable and removable elongated terminal electrode attached at its other end to a respective one of said ignition cables, said one end being generally flat and comprising a pair of spaced blades, each of said tubular walled tower projections characterized by guide means integrally formed on the inner wall thereof and cooperating with a cable terminal electrode for guiding insertion of said one end of a cable terminal electrode through an opening in the dome of the cap and into the interior of the cap, and the opening flexing the blades during insertion, with means for allowing the blades to return toward their relaxed condition when properly fully inserted into the opening and interlock with the cap.

10. A cap as claimed in claim 9, the free ends of the blades having tangs which interlock with the cap.

11. A cap as claimed in claim 10, the electrodes having stops which engage the cap to limit the maximum insertion thereof.

12. A cap as claimed in claim 9, said guide means being diametrically opposite narrow grooves formed in the inner wall of the tower.

13. A cap as claimed in claim 9, said cap including camming guide means on the inner walls of the towers for angularly orienting the corresponding electrode with respect to the corresponding opening during insertion.

14. A distributor cap having a central tower surrounded by a plurality of equally angularly spaced outer towers with an electrode disposed in the central tower, an improvement in the mounting of said electrode in the central tower comprising:

said central tower comprising an opening passing through the top of the cap with a plurality of integrally formed fingers extending into the interior of the cap at the inner end of the opening and retentatively engaging the contact on the cap with the contact including a flange which engages the top of the cap to limit the insertion of the contact into the opening and with the fingers retentatively engaging the contact at locations spaced below the shoulder of the contact.

* * * * *